US008704722B2

(12) United States Patent
Tsung-Wen et al.

(10) Patent No.: US 8,704,722 B2
(45) Date of Patent: Apr. 22, 2014

(54) MONOFREQUENCY ANTENNA INTEGRATED WITH COAXIAL FEED CABLE

(75) Inventors: Chiu Tsung-Wen, Xin-Dian (TW); Hsiao Fu-Ren, Xin-Dian (TW)

(73) Assignee: Advanced Connectek, Inc., Taipei County (TW)

( * ) Notice: Subject to any disclaimer, the term of this patent is extended or adjusted under 35 U.S.C. 154(b) by 493 days.

(21) Appl. No.: 13/070,322

(22) Filed: Mar. 23, 2011

(65) Prior Publication Data

US 2012/0162041 A1 Jun. 28, 2012

(30) Foreign Application Priority Data

Dec. 24, 2010 (TW) ..... 99145736 A

(51) Int. Cl.
*H01Q 9/04* (2006.01)

(52) U.S. Cl.
USPC ..... 343/791

(58) Field of Classification Search
USPC ..... 343/791
See application file for complete search history.

(56) References Cited

U.S. PATENT DOCUMENTS 8,487,827 B2 * 7/2013 Mukai et al. ..... 343/791

* cited by examiner

*Primary Examiner* — Kristy A Haupt
(74) *Attorney, Agent, or Firm* — Schmeiser, Osen & Watts, LLP

(57) ABSTRACT

A monofrequency antenna integrated with a coaxial feed cable comprises a first conductor, a second conductor and a feed cable. The feed cable includes a coating layer, an outer conductor, an insulating layer and a central conductor. The coating layer is formed on the outmost surface of the feed cable. The outer conductor is formed on the inner surface of the coating layer, extends in two opposite directions, and connects with the second conductor. The insulating layer is formed on the inner surface of the outer conductor and extends in two opposite directions. The first conductor is formed on the inner surface of the insulating layer and extends along one direction. The central conductor is formed on the inner surface of the insulating layer and extends along a direction opposite to the direction along which the first conductor extends. The present invention simplifies antenna structure and promotes transmission efficiency.

9 Claims, 2 Drawing Sheets

MONOFREQUENCY ANTENNA INTEGRATED WITH COAXIAL FEED CABLE

BACKGROUND OF THE INVENTION

1. Field of the Invention

The present invention relates to a monofrequency antenna integrated with a coaxial feed cable, particularly to a monofrequency antenna wherein a coaxial feed cable and radiation conductors are integrated in an antenna module.

2. Description of the Related Art

In an antenna, the central conductor of a coaxial feed cable is used to transfer signals to a radiation conductor where radiation energy is transmitted and received. Therefore, the connection configuration of a coaxial feed cable and a radiation conductor correlates with signal transmission quality and radiation performance of an antenna.

A coaxial feed cable comprises a coating layer, an outer conductor, an insulating layer and a central conductor in sequence from the surface to the center. The central conductor is connected with a radiation conductor, and the outer conductor is connected with a grounding plane of an antenna system.

Generally, five factors determine the operation performance of an antenna, including resonant frequency, impedance matching, bandwidth, radiation pattern and antenna gain. However, the abovementioned factors are greatly influenced by whether signals are appropriately fed into radiation conductors via the central conductor and outer conductor of a coaxial feed cable and whether the central conductor and outer conductor of a coaxial feed cable are connected with the radiation conductors at the optimized positions of the radiation conduction path.

SUMMARY OF THE INVENTION

The primary objective of the present invention is to provide a monofrequency antenna integrated with a coaxial feed cable, wherein the opposite-extension structure of the central conductor of a feed cable is used to integrate the feed cable and radiation conductors in an antenna module, whereby to achieve superior electric contact between the feed cable and the radiation conductor, provide an optimized radiation energy conduction path, and maintain stability of signal transmission.

Another objective of the present invention is to provide a monofrequency antenna integrated with a coaxial feed cable, wherein the opposite-extension structure of the central conductor of a feed cable exempts the antenna system from using additional extended radiation conductors, and wherein the feed cable and the radiation conductors are integrated into a one-piece component, whereby is simplified the antenna structure.

A further objective of the present invention is to provide a monofrequency antenna integrated with a coaxial feed cable, wherein a single-core central conductor is directly assembled to a support member of a connection terminal via tight gripping to enhance the strength of the connection structure and achieve superior assemblage precision and electric contact between the feed cable and the connection terminal, whereby the antenna system is exempted from circuit ramification circuits and short circuit of the transmission path of the high-frequency feed-in signal.

To achieve the abovementioned objectives, the present invention proposes a monofrequency antenna integrated with a coaxial feed cable, which comprises a first conductor, a second conductor and a feed cable. The feed cable includes a coating layer, an outer conductor, an insulating layer and a central conductor in sequence from the surface to the center. The coating layer is formed on the outmost surface of the feed cable. The outer conductor is formed on the inner surface of the coating layer, extends in two opposite directions, and connects with the second conductor. The insulating layer is formed on the inner surface of the outer conductor and extends in two opposite directions. The first conductor is formed on the inner surface of the insulating layer and extends along one direction. The central conductor is formed on the inner surface of the insulating layer and extends along a direction opposite to the direction along which the first conductor extends.

The present invention makes use of the opposite-extension structure of the central conductor of the feed cable to integrate the feed cable and the radiation conductors into an antenna module. Further, the present invention maintains superior electric contact between the feed cable and the radiation conductors. Furthermore, the present invention provides optimized radiation energy conduction paths and promotes stability of radiation signal transmission.

The present invention arranges the central conductor of the feed cable and the first conductor to respectively extend in two opposite directions and thus needn't use any additional complicated radiation conductors. Thereby, the present invention integrates the feed cable and the radiation conductors into a one-piece component. Therefore, the present invention has a simple antenna structure.

The present invention also proposes a monofrequency antenna integrated with a coaxial feed cable and a connection terminal thereof, wherein the central conductor of the feed cable and the radiation conductor are arranged to respectively extend in two opposite directions, and wherein the single-core central conductor is securely assembled to the support member of the connection terminal via tight gripping. The single-core structure of the central conductor increases the strength of the central conductor and exempts the antenna system from circuit ramification and short circuit of the high-frequency signal feed-in path. Thereby is promoted the radiation transmission performance of the antenna system and improved the assemblage precision and electric contact between the feed cable and the connection terminal.

Below, the embodiments are described in detail to make easily understood the technical contents of the present invention.

DETAILED DESCRIPTION OF THE INVENTION

Figure 1:
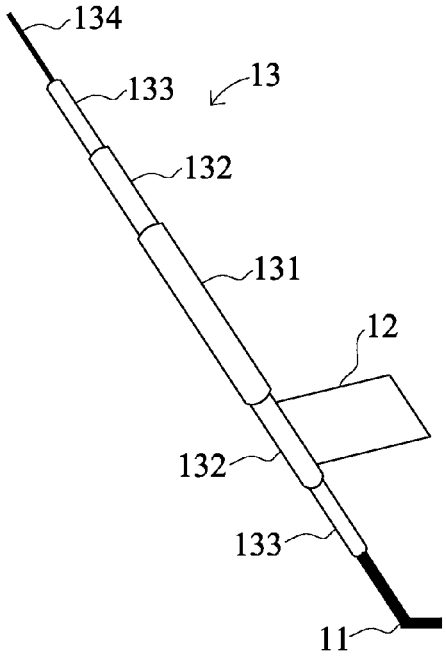
FIG. 1 is a top view schematically showing a monofrequency antenna integrated with a coaxial feed cable according to a first embodiment of the present invention.

Refer to FIG. 1 a top view schematically showing a monofrequency antenna integrated with a coaxial feed cable according to a first embodiment of the present invention. The monofrequency antenna of the present invention comprises a first conductor 11, a second conductor 12 and a feed cable 13. The feed cable 13 includes a coating layer 131, an outer conductor 132, an insulating layer 133 and a central conductor 134 in sequence from the surface to the center.

In the first embodiment, a thin metal thread is adopted as the first conductor 11, and a copper foil is used as the second conductor 12 functioning as the grounding plane of the antenna system. The coating layer 131 is formed on the outmost surface of the feed cable 13. The outer conductor 132 is formed on the inner surface of the coating layer 131, extends in two opposite directions, and connects with the second conductor 12. The insulating layer 133 is formed on the inner surface of the outer conductor 132 and extends in two opposite directions. The first conductor 11 is formed on the inner surface of the insulating layer 133 and extends along one direction. The central conductor 134 is formed on the inner surface of the insulating layer 133 and extends along a direction opposite to the direction along which the first conductor 11 extends. In the first embodiment, a single-core metal thread is used as the central conductor 134.

In the first embodiment, the first conductor 11 has an L-like shape and includes two straight segments. The segment connecting with the insulating layer 133 has a length of about 11 mm. The terminal segment has a length of about 6 mm. The second conductor 12 has a rectangular shape having a length of about 17 mm, a width of about 10 mm and a thickness of about 0.5 mm. The coating layer 131 of the feed cable 13 has a length of about 22 mm. The outer conductor 132 respectively extends in two opposite directions equidistantly by about 15 mm. The insulating layer 133 respectively extends in two opposite directions equidistantly by about 12 mm. The central conductor 134 has a length of about 10 mm.

Figure 2:
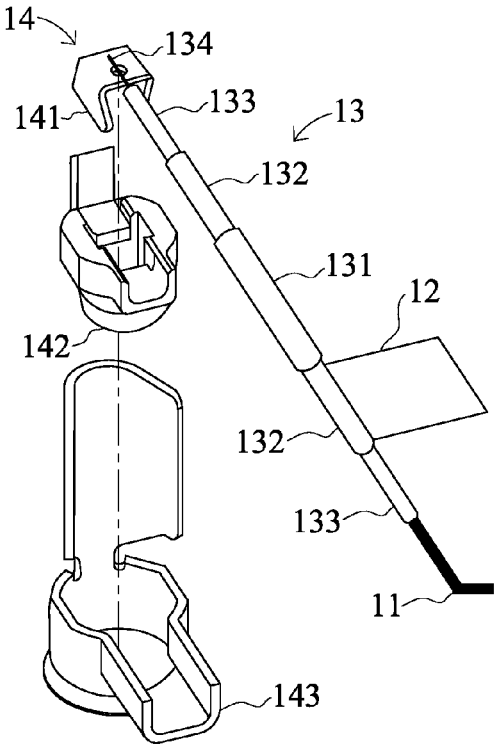
FIG. 2 is an exploded view schematically showing a monofrequency antenna integrated with a coaxial feed cable according to a second embodiment of the present invention.
Figure 3:
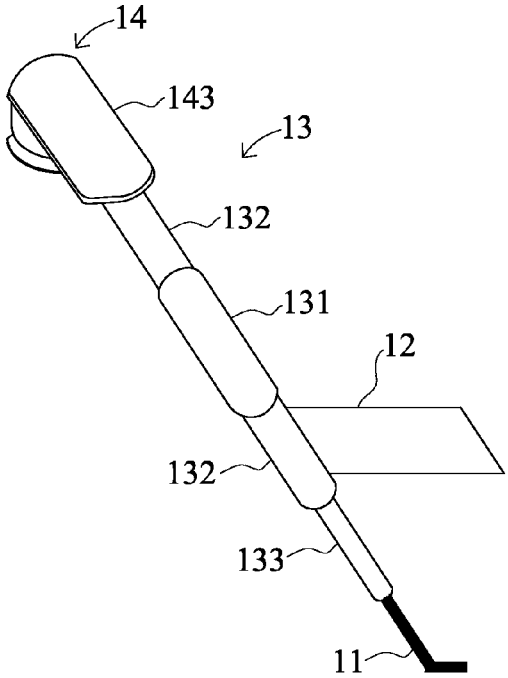
FIG. 3 is an assembly drawing schematically showing a monofrequency antenna integrated with a coaxial feed cable according to the second embodiment of the present invention.

Refer to FIG. 2 and FIG. 3 respectively an exploded view and an assembly drawing schematically showing a monofrequency antenna integrated with a coaxial feed cable according to a second embodiment of the present invention. The second embodiment is basically similar to the first embodiment but different from the first embodiment in that one end of the central conductor 134 of the feed cable 13 is assembled to a support member 141 of a connection terminal 14 via tight gripping. The connection terminal 14 includes a support member 141, a fixing member 142 and a base 143. The support member 141 is in form of a horse's hoof. The central conductor 134, which is in form of a single-core metal thread, is placed on the platform of the support member 141. Next, the support member 141 is placed in the fixing member 142. Then, the fixing member 142 is accommodated by the base 143.

In the present invention, the central conductor 134 and the first conductor 11 are respectively arranged in two opposite directions. Further, the single-core central conductor 134 is securely assembled to the support member 141 of the connection terminal 14. Thereby is avoided ramification of the signal feed-in circuits and achieved superior electric contact between the feed cable 13 and the connection terminal 14.

Figure 4:
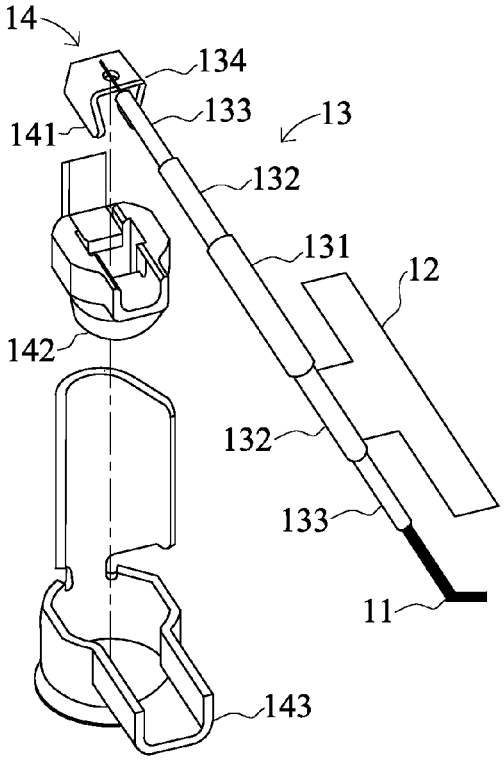
FIG. 4 is a perspective exploded view schematically showing a monofrequency antenna having a varied grounding plane according to the second embodiment of the present invention.

Refer to FIG. 4 a perspective exploded view schematically showing a monofrequency antenna having a varied grounding plane according to the second embodiment of the present invention. The present invention arranges the central conductor 134 of the feed cable 13 and the first conductor 11 to respectively extend in two opposite directions and thus needn't use any additional complicated radiation conductors. Therefore, the present invention has a simple antenna structure. Further, the second conductor 12, which adopts a copper foil to function as a grounding plane, extends in two opposite directions to increase the transmission area of the radiation conductors. Besides, the first conductor 11 is in form of a single-core metal thread, which favors the assemblage of the central conductor 134 of the feed cable 14 and the connection terminal 14.

The above description has proved that the present invention possesses utility, novelty and non-obviousness and meets the condition for a patent. However, the embodiments described above are only to exemplify the present invention but not to limit the scope of the present invention. Any equivalent modification or variation according to the spirit of the present invention is to be also included within the scope of the present invention.

What is claimed is:

1. A monofrequency antenna integrated with a coaxial feed cable, comprising:

a first conductor;

a second conductor;

a feed cable including a coating layer, an outer conductor, an insulating layer, and a central conductor disposed sequentially from the surface to the center, wherein said coating layer formed on an outmost surface of said feed cable, said outer conductor is formed on an inner surface of said coating layer, extended in two opposite directions, and connected with said second conductor, said insulating layer is formed on an inner surface of said outer conductor and extended in two opposite directions, said first conductor is formed on an inner surface of said insulating layer and extended from said insulating layer along one direction, said central conductor is formed on said inner surface of said insulating layer and extended along one direction opposite to said direction along which said first conductor extends, and said second conductor is in form of a copper foil to function as a grounding plane and extended in two opposite directions so as to increase a transmission area of radiation conductors.

2. The monofrequency antenna integrated with a coaxial feed cable according to clam 1, wherein said first conductor is in form of a thin metal thread.

3. The monofrequency antenna integrated with a coaxial feed cable according to clam 1, wherein said central conductor is in form of a single-core metal thread.

4. A monofrequency antenna integrated with a coaxial feed cable and a connection terminal thereof, comprising:

a first conductor;

a second conductor;

a feed cable comprising a coating layer, an outer conductor, an insulating layer, and a central conductor disposed sequentially from the surface to the center, wherein said coating layer formed on an outmost surface of said feed cable, said outer conductor is formed on an inner surface of said coating layer, extended in two opposite directions, and connected with said second conductor, said insulating layer is formed on an inner surface of said outer conductor and extended in two opposite directions, said first conductor is formed on an inner surface of said insulating layer and extended from said insulating layer along one direction said central conductor is formed on said inner surface of said insulating layer and extending along one direction opposite to said direction along which said first conductor extends, and said second conductor is in form of a copper foil to function as a grounding plane and extended in two opposite directions so as to increase a transmission area of radiation conductors;

a connection terminal including a support member supporting said central conductor;

a fixing member receiving said support member; and a base accommodating said fixing member.

5. The monofrequency antenna integrated with a coaxial feed cable and a connection terminal thereof according to claim 4, wherein said first conductor is in form of a thin metal thread.

6. The monofrequency antenna integrated with a coaxial feed cable and a connection terminal thereof according to claim 4, wherein said central conductor is in form of a single-core metal thread.

7. The monofrequency antenna integrated with a coaxial feed cable and a connection terminal thereof according to claim 4, wherein said support member is in form of a horse's hoof.

8. The monofrequency antenna integrated with a coaxial feed cable and a connection terminal thereof according to claim 4, wherein said fixing member is made of a non-conductive material.

9. The monofrequency antenna integrated with a coaxial feed cable and a connection terminal thereof according to claim 4, wherein said base is electrically connected with said outer conductor.

* * * * *